US005253922A

United States Patent [19]

Corlett

[11] Patent Number: 5,253,922

[45] Date of Patent: Oct. 19, 1993

[54] CHAIR ADJUSTABLE IN HEIGHT PROVIDING A WEIGHT BEARING SURFACE AT ANY HEIGHT, AND HAVING A SEAT THAT ROTATES SO AS TO CHANGE ITS ANGLE OF INCLINATION

[75] Inventor: Esmond N. Corlett, Nottingham, England

[73] Assignee: British Technology Group Limited, London, England

[21] Appl. No.: 774,735

[22] Filed: Oct. 10, 1991

Related U.S. Application Data

[63] Continuation of Ser. No. 442,696, Nov. 29, 1989, abandoned, which is a continuation-in-part of Ser. No. 197,002, May 23, 1988, abandoned.

[30] Foreign Application Priority Data

May 23, 1987 [GB] United Kingdom ..... 8712288
Nov. 29, 1988 [GB] United Kingdom ..... 8827846

[51] Int. Cl.[5] ..... A47C 3/40

[52] U.S. Cl. ..... 297/344.16; 297/195.1; 297/337

[58] Field of Search ..... 297/195, 325–328, 297/330, 337, 338, 339, 344, 345, DIG. 10; 248/277, 421

[56] References Cited

U.S. PATENT DOCUMENTS

| | | | |
|---|---|---|---|
| 2,690,208 | 9/1954 | Mary | 297/195 |
| 2,942,652 | 6/1960 | Chapman | 297/458 |
| 4,377,309 | 3/1983 | Mengshoel | 297/195 X |
| 4,614,378 | 9/1986 | Picou . | |

FOREIGN PATENT DOCUMENTS

| | | | |
|---|---|---|---|
| 0179748 | 4/1986 | European Pat. Off. . | |
| 0268746 | 6/1988 | European Pat. Off. . | |
| 0293136 | 11/1988 | . | |
| 2032533 | 2/1980 | Fed. Rep. of Germany | 297/345 |
| 2837558 | 3/1980 | Fed. Rep. of Germany . | |
| 2837618 | 3/1980 | Fed. Rep. of Germany . | |
| 2519861 | 7/1983 | France | 297/DIG. 10 |
| 2552988 | 4/1985 | France . | |
| WO8501643 | 4/1985 | PCT Int'l Appl. . | |
| 248923 | 7/1969 | U.S.S.R. | 297/345 |

*Primary Examiner*—Peter R. Brown
*Attorney, Agent, or Firm*—Cushman, Darby & Cushman

[57] ABSTRACT

A chair which can support a person in both a seated and standing position includes a tiltable seat the angle of which can be changed with the height of the chair. In a preferred embodiment the uppermost surface of the seat is always horizontal.

2 Claims, 9 Drawing Sheets

CHAIR ADJUSTABLE IN HEIGHT PROVIDING A WEIGHT BEARING SURFACE AT ANY HEIGHT, AND HAVING A SEAT THAT ROTATES SO AS TO CHANGE ITS ANGLE OF INCLINATION

This is a continuation of application Ser. No. 07/442,696, filed on Nov. 29, 1989, abandoned which is a CIP of Ser. No. 07/197,002, filed Mar. 23, 1988 abandoned.

BACKGROUND OF THE INVENTION

1. Field of the Invention

The present invention relates to chairs and more particularly to chair seats designed to support the body of a human being (the user) at variable heights.

2. Description of the Prior Art

Chairs are normally designed to support a user in a sitting position even though the height at which the user sits can be adjusted to suit users of different heights. Known adjustment systems comprise spring loaded central support columns or gas filled cylinder systems controlled by a lever adjacent the chair seat.

SUMMARY OF THE INVENTION

The present invention is particularly concerned with the design of a chair which can support a user at a height approximately equal to the normal standing height of the user. Since users vary in height over a wide range, the chair must be capable of being adjustable in height over such a wide range and also be capable of supporting a user in both a normal (low) sitting position and in a sit/stand (high or semi-standing) position whereby the user stands at for example 90% or normal standing height.

According to the present invention there is provided a chair having a seat, means for adjusting the height of the seat and co-operative means for adjusting the angle of tilt of the seat to provide respectively an upward and downward variation in tilt in the forward direction with decrease and increase in the height of the seat as a whole.

Preferably the angle of tilt of the seat is adjusted by the co-operative means comprising a lever system attached to a base portion of the seat.

In a particular embodiment the lever system is active to adjust the position of a backrest relative to the seat as the seat is raised and lowered.

The seat is preferably substantially a convex arcuate shape in side cross-sectional elevation and substantially rectangular in front cross-sectional elevation.

The seat is preferably wider in cross-section at the rear most portion and narrower in cross-section at the front portion.

In a preferred embodiment the upper surface of the seat comprises a convex curve having three different radii of curvature the longest being at the rear edge of the seat and the shortest being at the front edge of the seat.

According to a second aspect of the present invention there is also provided a chair comprising:

a seat;

means for raising and lowering said seat to any height in a range from a fully seated, low, position to a semi-standing, high, position;

a horizontal section which, in any position of said range, supports weight of a user; and co-operative means for adjusting an angle of tilt of said seat so as to accommodate needs of said user in any position in said range, said co-operative means providing forward and backward rotation of said seat as said seat is raised or lowered in order to alter said angle of said seat such that legs of said user in said semi-standing position are clear of a front portion of said seat.

BRIEF DESCRIPTION OF THE DRAWING

Embodiments of the present invention will now be described, by way of example with reference to the FIG. 1 shows a chair according to the present invention in front elevation.

DETAILED DESCRIPTION OF THE PRESENTLY PREFERRED EXEMPLARY EMBODIMENT

Figure 1:
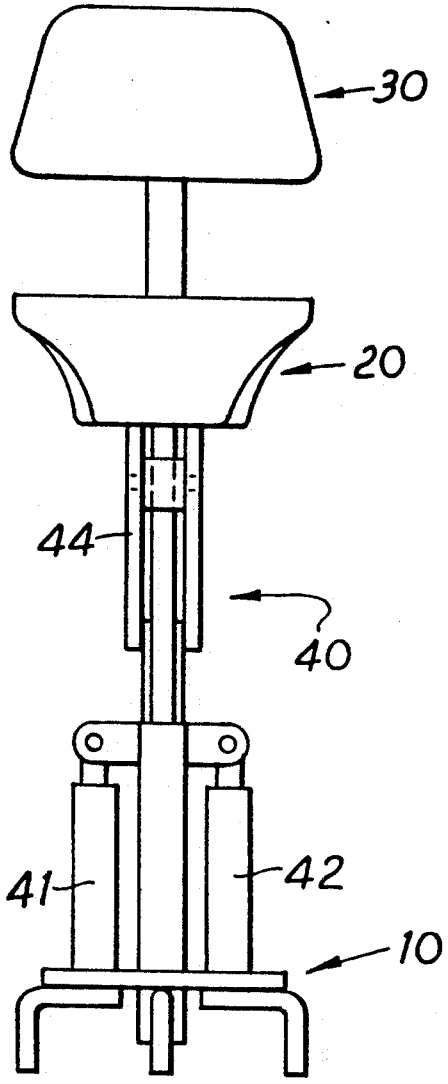
Figure 2:
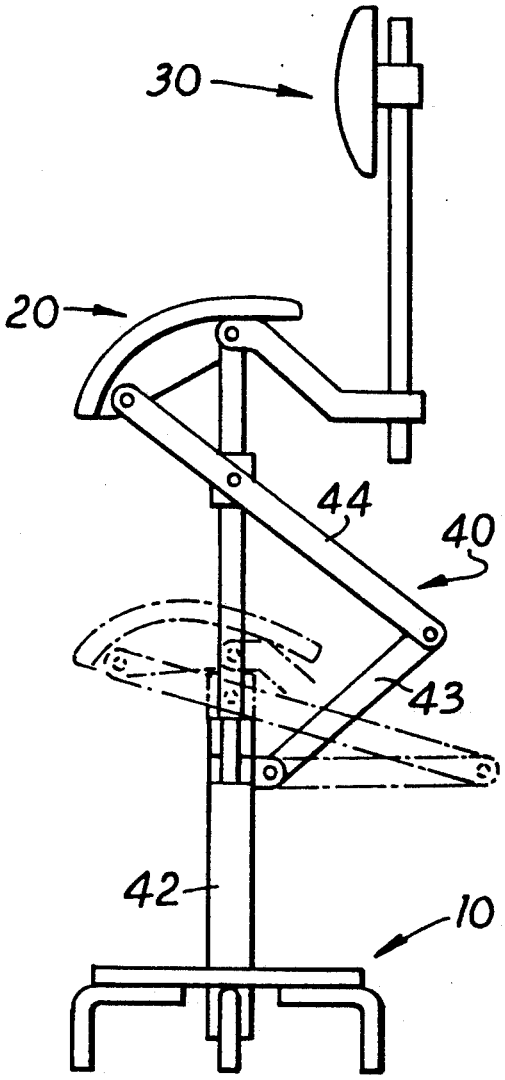
FIG. 2 shows the chair of FIG. 1 in side elevation.

With reference now to FIGS. 1 and 2 a first chair according to the present invention comprises a base 10, seat portion 20, a backrest 30 and a lifting and tilting mechanism 40.

The base 10 may be of any conventional form, for example five star. The lifting mechanism may comprise two hydraulic cylinders 41, 42 which may be operated via a conventional lever (not shown) to raise the height of the seat 20. The tilting mechanism comprises two levers 43, 44 pivoted as shown and attached to the front of seat 20 and a shaft 50 as shown such that as the height of the seat increases the front edge of the seat is tilted downwards in a controlled manner as predetermined by the length of the levers 43, 44. In this design the backrest 30 remains in a relatively fixed position to the seat 20 as the seat is raised.

Figure 3:
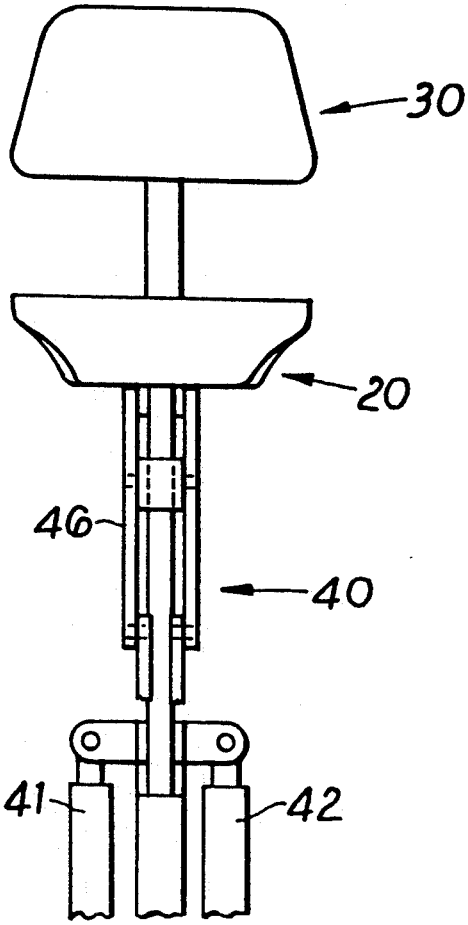
FIG. 3 shows a second chair according to the present invention in front elevation.
Figure 4:
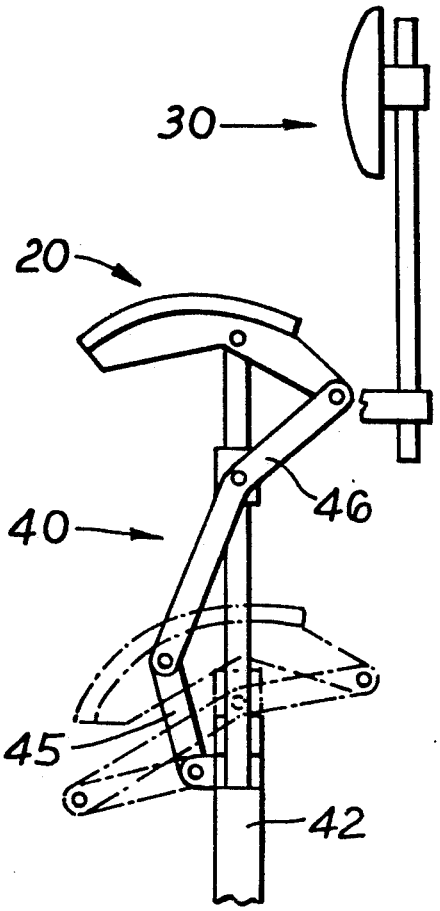
FIG. 4 shows the chair of FIG. 3 in side elevation.
Figure 5:
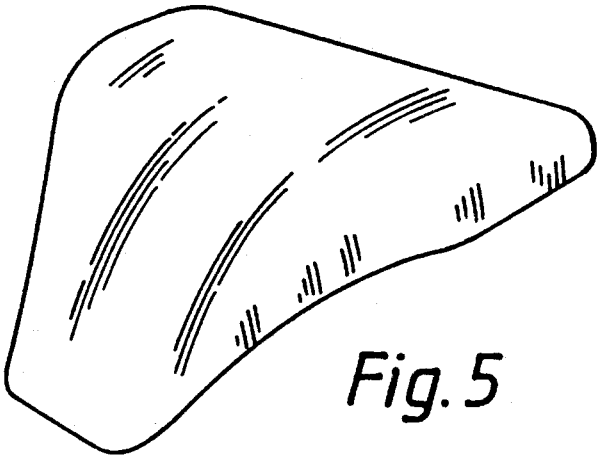
FIG. 5 shows a perspective view of a seat suitable for the chairs of FIGS. 1 to 4.
Figure 6:
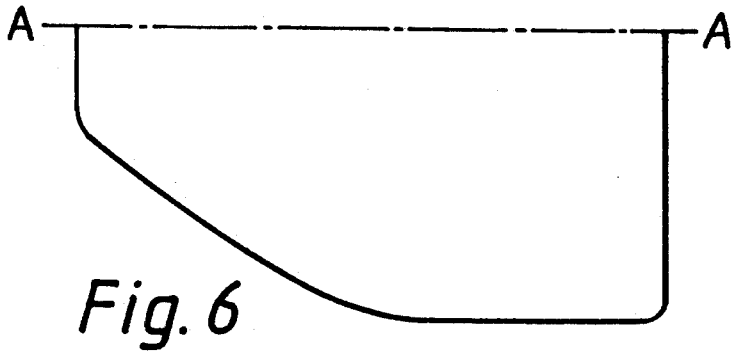
FIG. 6 shows a plan view of one half of the seat of FIG. 5.
Figure 7:
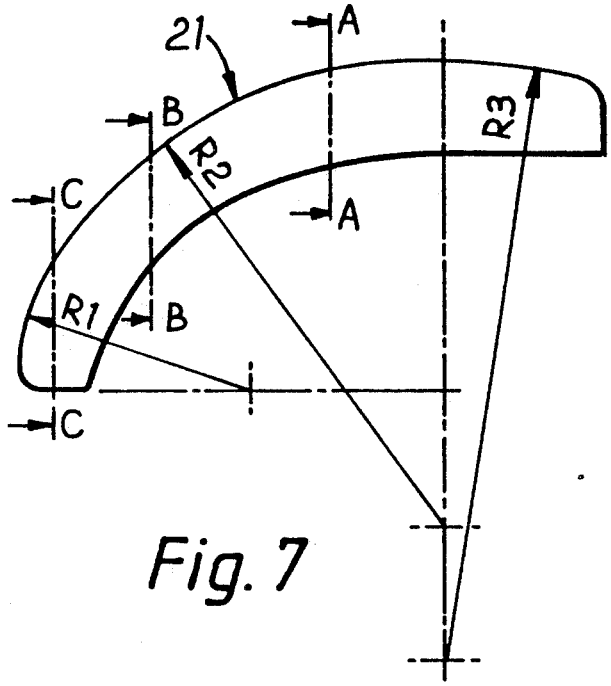
FIG. 7 shows a cross-section of the seat of FIG. 6 on line "A—A"

With reference now to FIGS. 3 and 4 an alternative design of chair is shown again comprising a base 10 (as in FIGS. 1 and 2 and not shown) in FIGS. 3 and 4 a seat 20 a raising and tilting mechanism 40 and a backrest 30. The lifting mechanism again includes hydraulic cylinders 41, 42 to raise and lower the seat 20 as in FIGS. 1 and 2. The tilting mechanism comprises levers 45 and 46 (the tilting mechanism in this embodiment is normally positioned) and which, again by their pivoted action cause the front edge of the seat to be lowered as the height of the seat increases. The shaft 50 is shown extended in FIG. 4. In this embodiment the lever 46 is attached to the underneath rear of seat 20 and the height of the backrest 30 is adjusted as the seat height is adjusted.

The seat is specifically designed such that there is always a horizontal portion of the seat to be sat on by the user for support at all heights within the designed height range. The shape of seat 20 is shown in FIGS. 5 to 8 and with reference to FIG. 7 the seat is contoured to provide an upper surface 21 the shape of which is dictated by three arcs of radii R1, R2 and R3 as shown. The seat is shaped to be narrower at the front as indicated by the cross-sectional shapes $A^1$—$A^1$, $B^1$—$B^1$ and $C^1$—$C^1$ shown in FIG. 8 and by the plan view of FIG. 6.

With respect to the cross-sections the upper surface 21 of the seat need not necessarily be flat but could be contoured to provide for example a domed shape which may be more comfortable or a seat contoured to accommodate the shape of the upper legs or thighs. The seat may be provided for example with a tensioned net or canvas sling stretched over a suitable frame.

Figure 9:
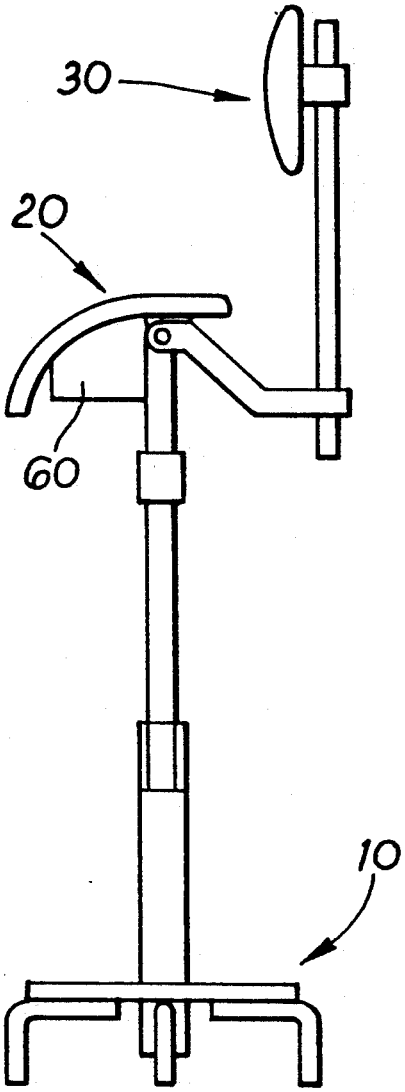
FIG. 9 shows the chair with an electrically driven motor replacing the links.
Figure 10:
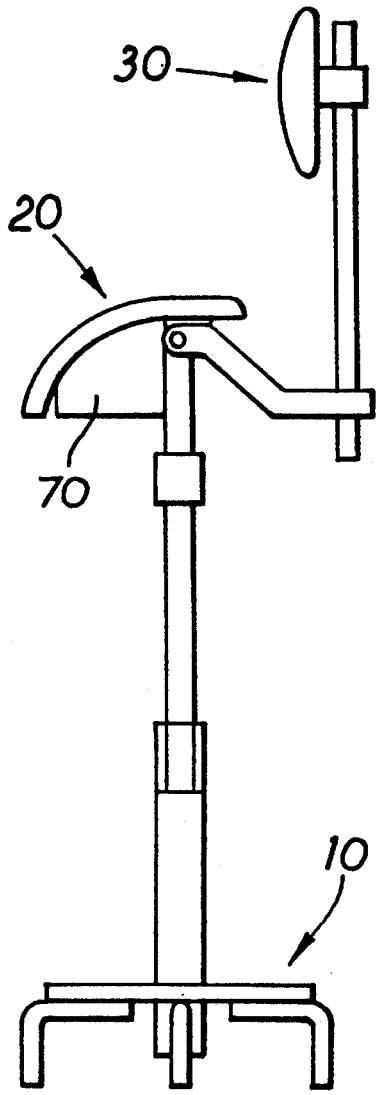
FIG. 10 shows the chair with control cylinders replacing the links.

The tilting action may be brought about by a coordinated movement of control cylinders 70 in FIG. 10 rather than a series of links or by an electrically driven motorized system as shown as 60 in FIG. 9. This would enable a more complex tilting sequential movement to be obtained if required.

In a particular embodiment the dimensions of the radii R1, R2 and R3 are as follows:

R1—140 mm
R2—280 mm
R3—350 mm

These dimensions are given only by way of example and may be varied to suit specific requirements.

Figure 11:
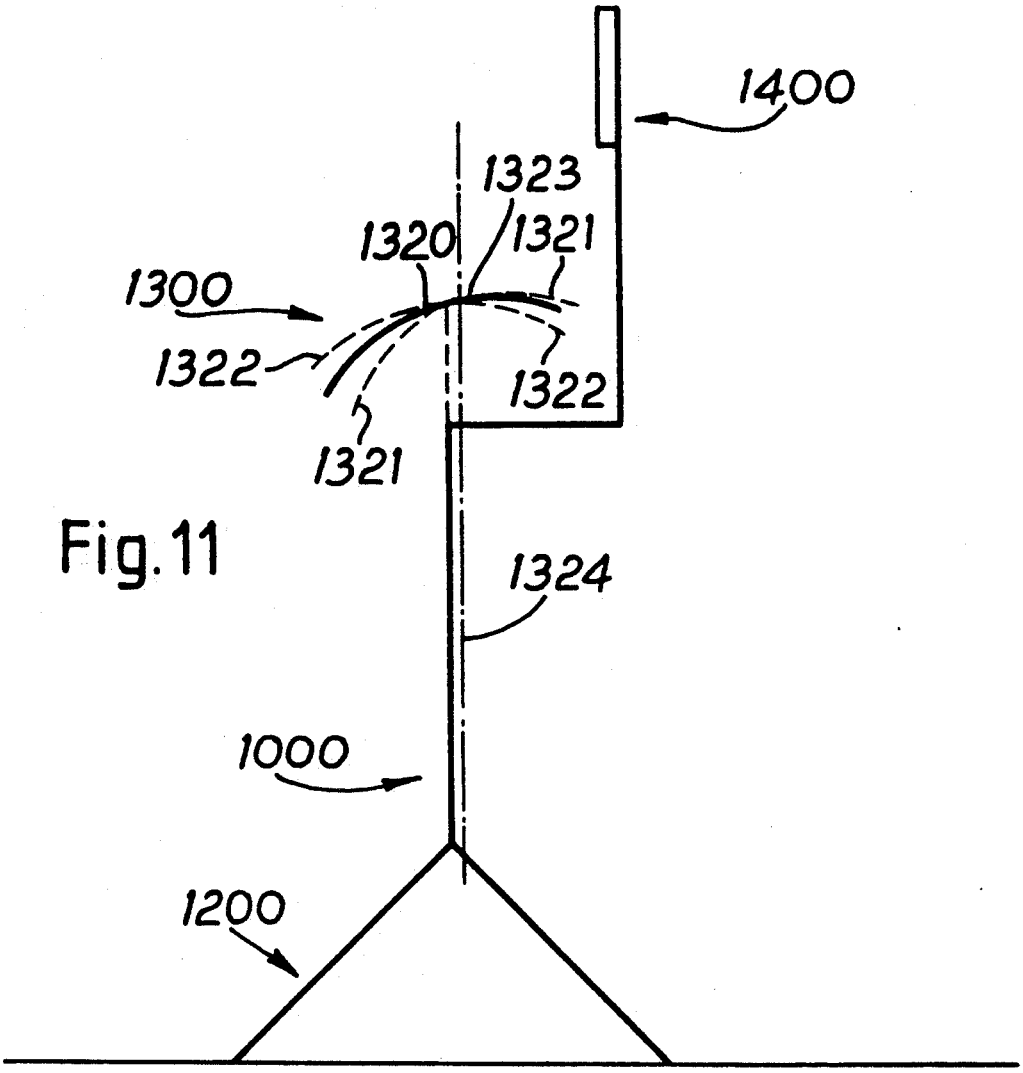
FIG. 11 shows schematically a third chair according to the present invention.

With reference now to FIG. 11, a third chair 1000 is shown diagrammatically. The chair comprises three basic component parts, a base 1200, a seat 1300 and a backrest 1400 (if provided). The base 1200 may be of the star or similar known type providing a stable base providing that the weight on the chair is within the area of the base. The backrest 1400 (if fitted) may be attached to the seat in a known manner.

The seat 1300 has an upper curved surface 1320 and may be adjusted or set at a number of angles as shown by dotted lines 1321, 1322. Dotted line 1321 is suitable for a higher position of the chair corresponding to a stand position for the user and dotted line 1322 is suitable for a lower position for the chair corresponding to a sitting position for the user.

In the present invention the highest "point" on the surface of the seat shown diagrammatically at 1323 is shown on the vertical dotted line 1324. As the seat 1300 is adjusted into the positions shown at 1321 and 1322 the highest "point" of the seat will in the seat design according to the present invention still remain substantially on the line 1324.

Figure 12:
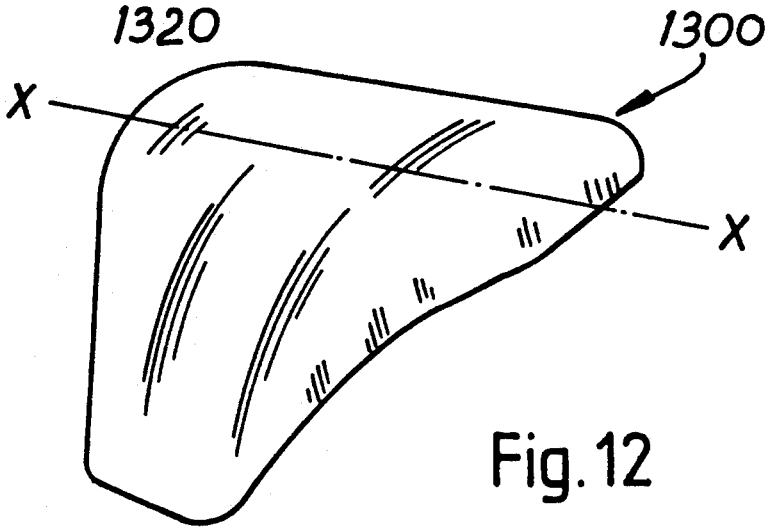
FIG. 12 shows a perspective view of a first seat according to the present invention suitable for the chair of FIG. 11.

In a practical seat design in three dimensions, as opposed to the diagrammatic representation shown in FIG. 1, the line 1324 is in fact a plane and the point on the seat comprises a horizontal line across the seat as indicated by line X—X in FIG. 12 to which reference is now made.

The seat shown in FIG. 12 is specifically designed such that there is always an uppermost horizontal position of the seat X—X to be sat on by the user for support at all heights within the designed height range. The shape of seat 1300 shown in FIG. 12 may in a preferred embodiment be identical to the seat shape shown in FIGS. 5 to 8.

In a similar manner to seat shape 30 of FIGS. 5 to 8 with respect to the cross-sections the upper surface 1320 of the seat is shaped to accommodate the shape of the upper legs or thighs and in a practical embodiment can be contoured by suitable upholstery to provide for example a domed shape which may be more comfortable. The seat may be provided for example with a tensioned net or canvas sling stretched over a suitable frame. The seat however always provides, when sat on an uppermost horizontal portion X—X which thus supports the user comfortably.

Figure 13:
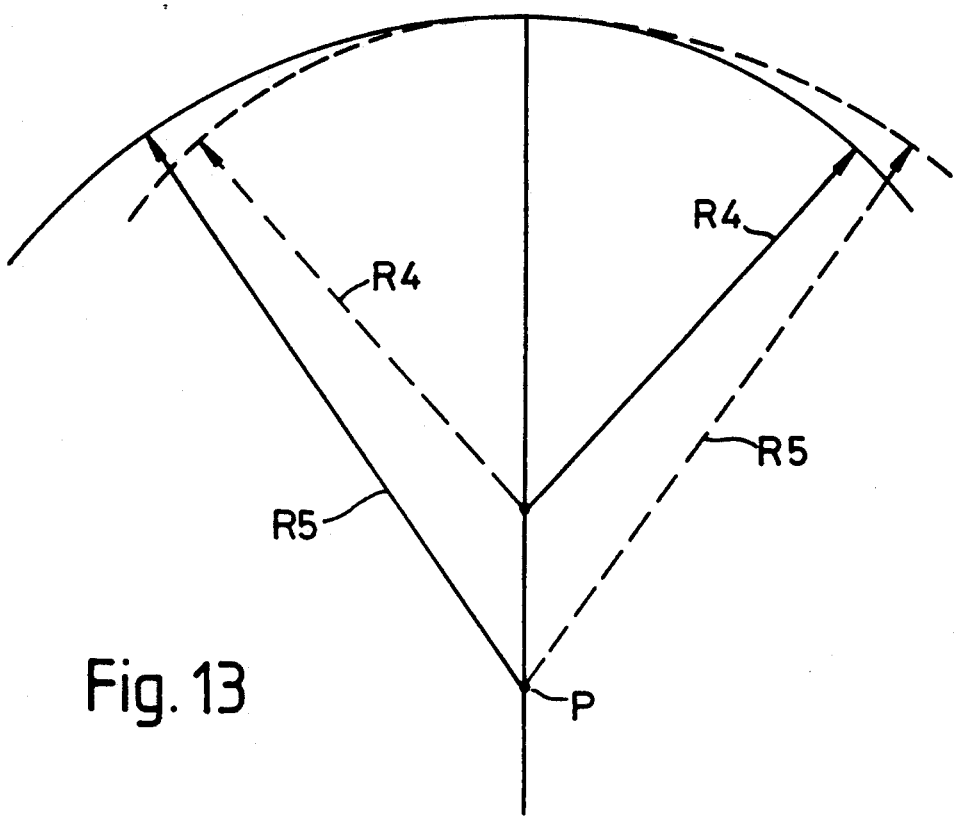
FIG. 13 shows diagrammatically the design of a second seat according to the present invention suitable for the chair of FIG. 11.

With reference now to FIG. 13 a simpler contour for the seat is shown comprising two arcs of radii R4 and R5 as shown. Radius R4 is the shorter and is used as indicated by the solid line to form the back of the seat and R5 is the longer and is used to form the front of the seat as shown by the solid line. The dotted continuation lines of arc are only shown to illustrate the differences in the radii. The seat is pivoted about point P to achieve the desired property of maintaining an uppermost horizontal line X—X to sit on at all angles of pivot of the seat.

Figure 8:
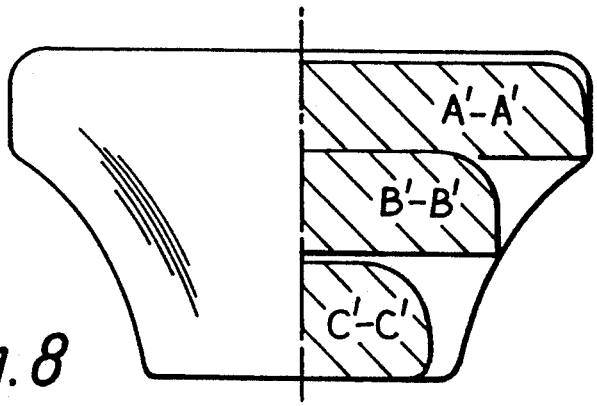
FIG. 8 shows a part cross-sectional front elevation of the seat of FIG. 5.

With reference to FIG. 8, the seat shape could, however, be of the more conventional substantially rectangular shape as indicated by the dotted lines.

Figure 14:
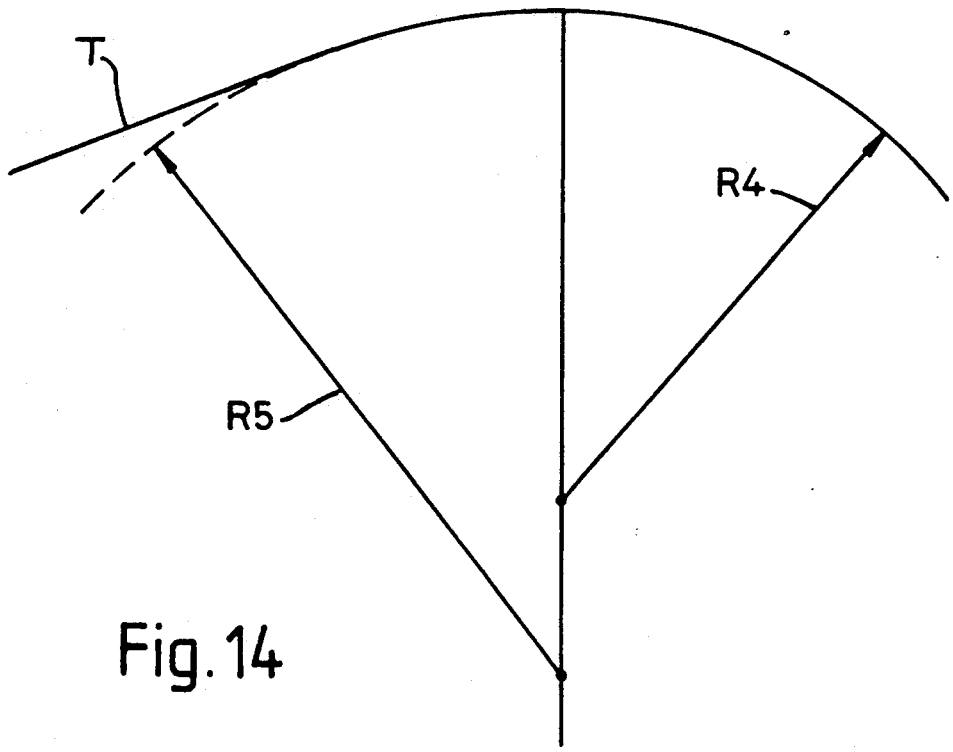
FIG. 14 shows diagrammatically the design of a third seat according to the present invention suitable for the chair of FIG. 11.

A modification of the seat contour of FIG. 13 is shown in FIG. 14, the radius R5 being replaced by a tangential shape as indicated by the straight line R, radius R5 being shown dotted for comparison.

In a practical embodiment R4=140 mm and R5=200 mm.

The seats may be of the form shown in FIG. 12 contoured for the thighs.

The seat shapes shown may be set at fixed angles for various types of seat and they will always provide an uppermost substantially horizontal line X—X for the user to sit on. In practice this line will, in an upholstered or padded seat, provide a generally horizontal platform sloping at its extremities both to the back and the front of the seat. Thus the user will not be unbalanced on the seat since there will be no tendency to slide to the front or back of the seat. This is particularly advantageous since any such tendency is always resisted by a user causing strain. The seat design according to the present invention is therefore comfortable to sit on at all heights at which it is set. Thus for example for laboratory stools the seat can be set for a high level use and for typing chairs it can be set at a low lever.

Figure 15:
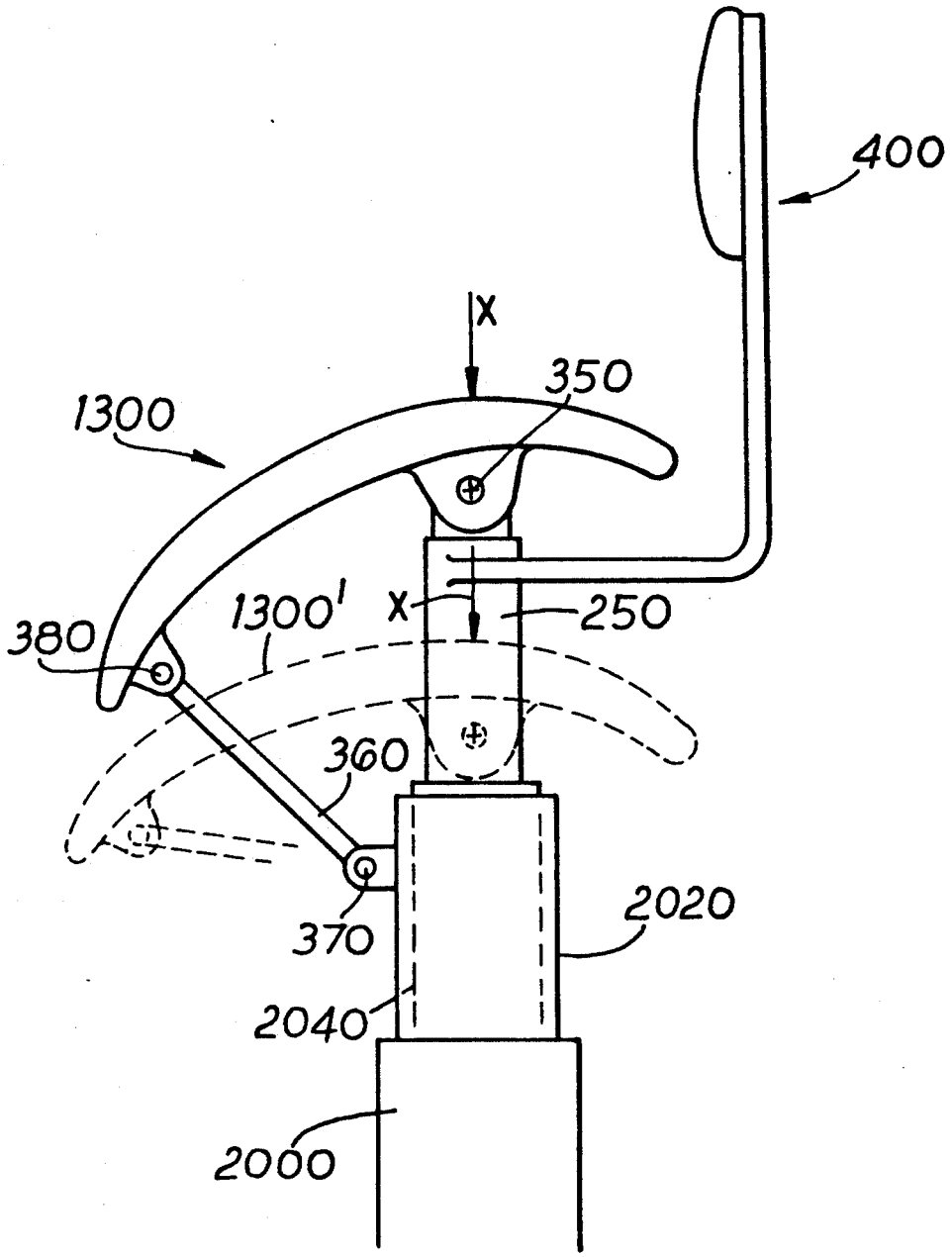
FIG. 15 shows a suitable adjustment mechanism for use with the chair of FIG. 11 to provide an automatic tilting action for the seat.

If it is required to provide an automatic adjustment of the angle of the seat, the embodiment of FIG. 15 may be used. In FIG. 15 the upper part of a chair is shown and comprises the seat 1300 pivoted on a pivot 350 attached to a main support member 250.

A first height adjustment is provided by, for example, a gas filled cylinder 2000. This is used to adjust the seat for the height of the user for example at the lowest or sitting position by altering the height of ram 2020. Once set for a particular user this cylinder 2000 would not be further altered.

A further cylinder 2040 is positioned within ram 2020 to provide further vertical movement of seat 1300. To further alter the height of seat 30 cylinder 2040 is activated by means of, for example, a lever in known manner to allow main support member 250 to move upwardly under the force of the cylinder or downwardly under the weight of the user on the seat 1300. As member 250 moves into or out of cylinder 2040 so seat 1300 is moved by an arm 360 connected in a pivotal manner between ram 2020 and the front of the seat at pivot points 370, 380. The seat 1300 will therefore move as indicated by dotted outline 1300[1]. Line X—X (as indicated by the arrow X) will as shown always be at the highest point on the seat and in this embodiment this line is vertically above the main support member 250 providing the most stable condition for the seat.

As an alternative to the automatic adjustment provided by arm 360 a manual adjustment could be provided by a suitable screw clamp on pivot 350 allowing the seat to be rotated to suit the user. Line X—X will however always be the highest portion of the seat.

Figure 16:
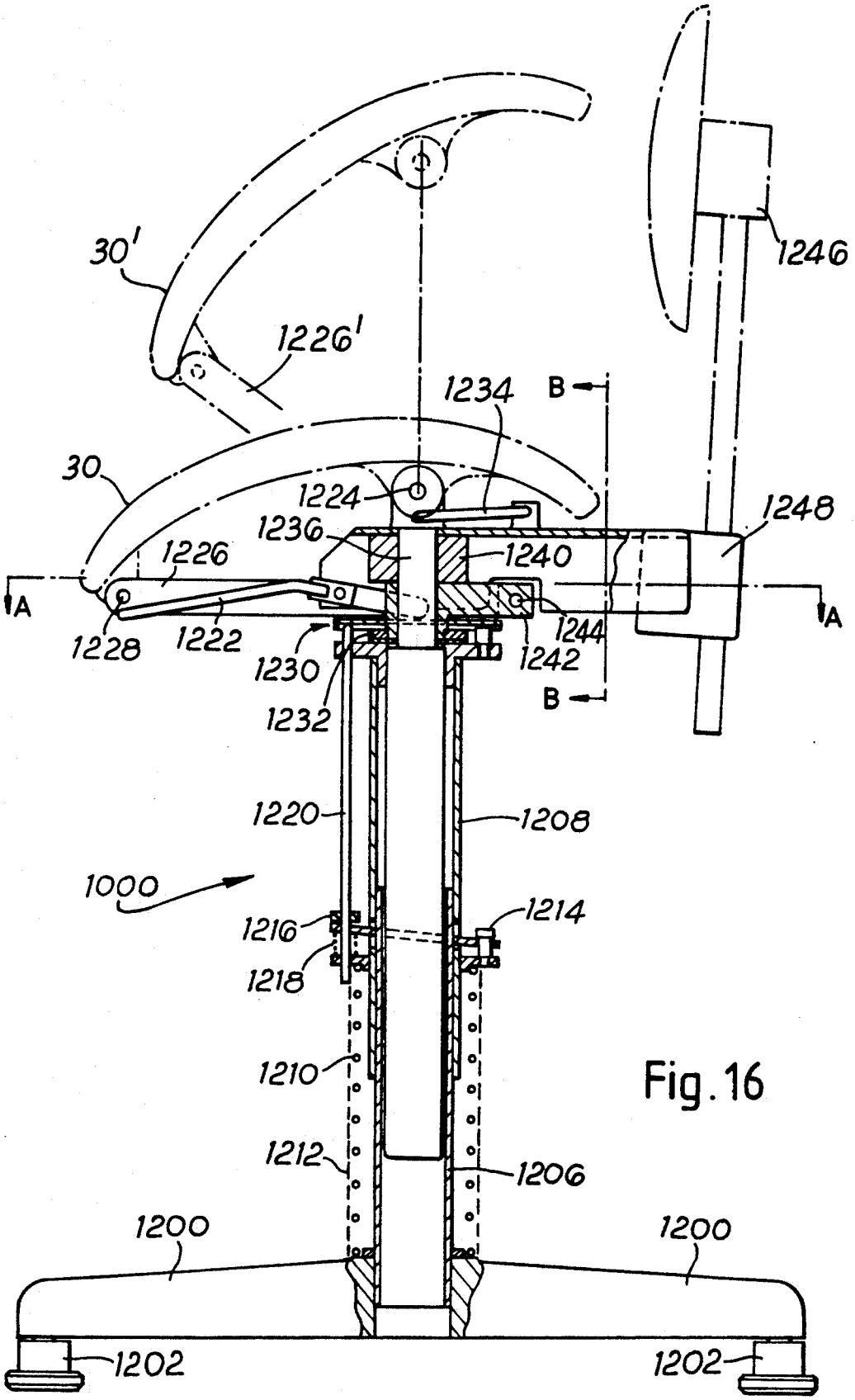
FIG. 16 shows in elevational partial cross-section a practical embodiment of a chair incorporating a seat according to the present invention.
Figure 17:
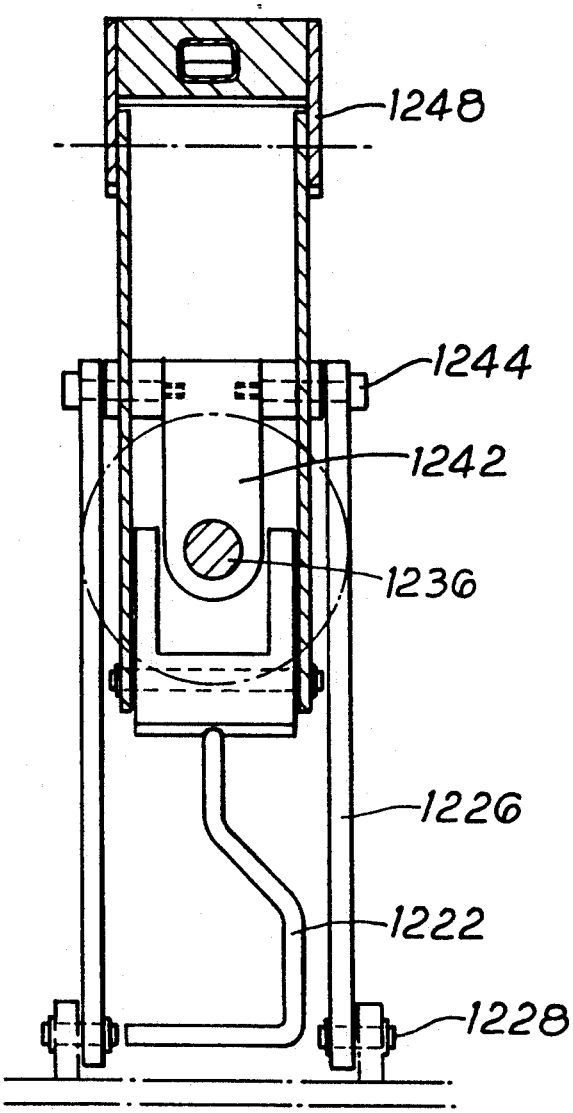
FIG. 17 shows a cross-sectional view along line A—A of FIG. 16.
Figure 18:
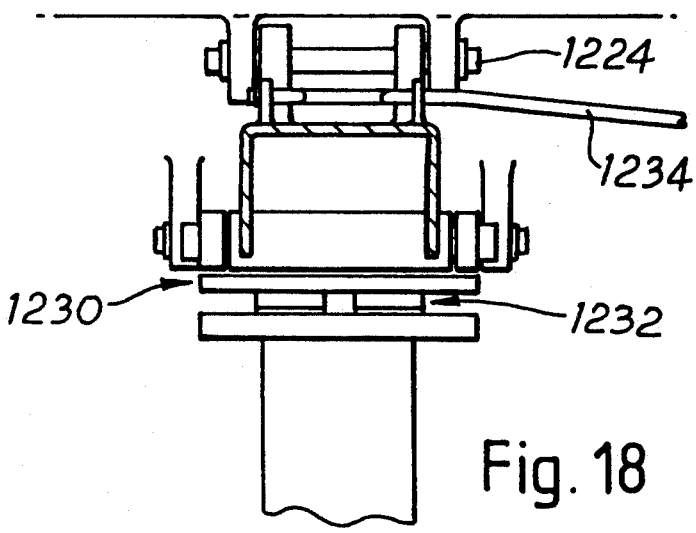
FIG. 18 shows a cross sectional view along line B—B of FIG. 16.

With reference now to FIGS. 16–18 a practical embodiment of a chair incorporating a seat according to the present invention is shown.

The chair 100 comprises a base 1200 which may be of the conventional three or five star configuration. In the drawing only two feet 1202, 1204 are shown for simplicity of drawing. A first main support member 1206 is fixed; for example by welding into the base 1200 and a second main support member 1208 is slidably mounted over the first member 1206 as shown. Preferably each support member 1206, 1208 comprises a steel tube of circular cross section.

Support member 1208 is movable vertically relative to support member 1206 by means of a spring 1210 (which in a practical chair would be provided with a cover 1212 shown as a dotted line).

The two members are normally locked together by a locking arrangement 1214, 1216 which operates in known manner to allow relative movement between the members on compression of a spring 1218. This is achieved by a downward movement of operating rod 1220 by downward operation of a lever 1222 which is situated under the front of seat 30 (FIG. 1). This movement is well known in such chair designs and will not therefore be described in any greater detail. The lift provided for the chair seat by this arrangement is in the chair shown 120 mm (approx. 5 inches) which accommodates for the sitting position height range. It is noted here that the angle of the seat 30 does not change due to operation of lever 1222.

The seat 30 is pivotally supported on a pin 1224 and tilting of the seat is accomplished by the pivotal connection of the front of the seat to a lever 1226 on a pivot pin 1228. The seat is supported on a platform 1230 which is mounted on a bearing 1232 which enables the seat to be revolved.

The seat 30 may be raised by operation of a lever 1234 into the position shown partially at 30[1] and 1226[1]. The lever 1234 operates when depressed to release the piston 1236 and allow the seat to rise (in known manner) under the pressure provided by either a pneumatic pressure or by a further spring (not shown). The seat may be lowered by operating the lever 1234 and pressing down on the top of the seat. The lift provided for the seat in a preferred practical embodiment is 245 mm (10 inches).

The operation of the seat may be clearly seen by the two positions 30, 1226 and 30[1], 1226[1]. As the piston 1236 rises the upper portion 1240 of the platform 1230 rises relative to the base portion 1242 to which the opposite end of lever 1226 is pivotally connected at pivot point 1244. Thus as the seat rises the angle of the seat is tilted gradually, the seat always having a horizontal portion to support the user.

A backrest 1246, 1248 is also attached to the upper part 1240 of the platform 1230 so that the backrest rises with the seat.

I claim:

1. A chair, comprising:

a seat having a front portion, a rear portion and a curved exterior surface therebetween;

means for raising and lowering said seat to any height in a range from a fully seated, low, position to a semi-standing, high position;

cooperative means connected to said seat for adjusting an angle of tilt of said seat as the height of said seat is changed; and said seat having a curvature such that an imaginary horizontal transverse line drawn thereacross at the highest position on said curved exterior surface will move towards a rear portion of said seat as said seat is moved from said low position to said high position; and a backrest, said backrest being attached to said raising and lowering means and being independent of said seat, said backrest remaining in a substantially vertical position as said seat is raised and lowered.

2. A chair as claimed in claim 1, wherein the curved exterior surface has at least two radii of curvature.

* * * * *